US006024246A

United States Patent [19]

Huang

[11] Patent Number: 6,024,246

[45] Date of Patent: Feb. 15, 2000

[54] STRUCTURE OF SQUEEZE LID

[76] Inventor: Hsien-Tu Huang, No. 56, Min Sheng Street, Feng-Yuan City 420, Taiwan

[21] Appl. No.: 09/208,598

[22] Filed: Dec. 8, 1998

[51] Int. Cl.[7] ..... B65D 45/32

[52] U.S. Cl. ..... 220/780; 220/319; 215/279; 215/317

[58] Field of Search ..... 220/319, 780, 220/782; 215/274, 279, 317, 321

[56] References Cited

U.S. PATENT DOCUMENTS

| | | | |
|---|---|---|---|
| 2,031,531 | 2/1936 | Fiese | 215/279 |
| 2,238,299 | 4/1941 | Wilson | 215/279 |
| 4,116,352 | 9/1978 | Davis | 215/270 |
| 4,942,974 | 7/1990 | Larrison | 220/214 |

*Primary Examiner*—Stephen K. Cronin

[57] ABSTRACT

A structure of squeeze lid is provided. The squeeze lid includes a cyliner container having an upper opening and a sloped flange slightly extending outward from the opening; a squeeze lid of a circular body having a first and second lower flanges concentrically formed and extending downward from the edge of the body to define an annular gap therebetween engageable with the sloped flange of the container, an upper flange extending upward from the edge of the body including a plurality of radial slits fromed spaced apart in the circulity of radial slits fromed spaced apart in the circumference and a reinforcement ring engageable into a circular space moving outward so as to effect the second lower flange to move inward in order to tightly close the upper opening of the container which may decorate with patterns to be used as a cup or vase.

5 Claims, 9 Drawing Sheets

STRUCTURE OF SQUEEZE LID

BACKGROUND OF THE INVENTION

The present invention relates the lids of containers or jar and more particularly to a squeeze lid of container which lid is adaptable to cover a non-threaded cup jar container or the like and tightly covers the container without thread on the rim so that container containing beverages, food or any other objects can be used repeatedly as a cup, glass or a vase for flower.

Typical containers as shown in FIG. 1 comprises a cylinder body 1, an opening or mouth 3 and a threaded neck 2 engagealbe with a threaded lid 4. This container may be made of glass, plastic, metal or pottery, it always casts away because of its threaded neck which looks not so graceful and elegant to be utilized as a cup or vase for culturing flowers.

FIG. 2 shows another type of container which comprises a cylinder body 100, an opening 5, a flanged rim 6 and a lid 7 which includes a double-layer downward flange 9 to define an annular gap 8 engageable with the flanged rim 6 of the container. This type of container may be utilized as a cup or vase but the lid 7 could not tightly cover the container.

SUMMARY OF THE PRESENT INVENTION

The squeeze lid of the present invention comprises generally a cylinder container having a sloped flange around upper rim slightly toward outward and a squeeze lid which is made of flexible material and includes a cirscular body, a double annular flange extending downward from the edge of the body so as to define an annular gap therebetween engageable with the sloped flange of the container, a cushion ring disposed into the gap and a reinforcement ring squeezing an upper annular flange of the lid. When the lid covers the container, the reinforcement ring squeezes the upper annular flange to force an outer partion of the double annular flange moving inward closer to the sloped flange of the container. So that the lid is tightly covering the container. If opens the lid, just removes the reinforcement ring, then the outer partion of the double flange disengages the sloped flange of the container so as to readily open the lid up.

Accouringly, the present invention has a main object to provide a structure of squeeze lid which can tightly cover a container without thread so as to keep the container to be looked graceful and elegant for better use.

The present invention will become more fully understood by reference to the following detailed description when read in conjunction with the attached drawings.

FIGS. 1 and 2 are the exploded perspective views showing the containers of the prior art, FIG. 3 is an exploded perspective view to show a preferred embodiment of the present invention, FIG. 4 is an exploded sectional view of FIG. 3, FIG. 5 is an exploded sectional view of FIG. 1 when the lid covers the container, FIG. 6 is a sectional view of FIG. 1 when the reinforcement ring squeezes into the upper flange of the lid, FIG. 7 is a perspective view to show a closed container of the present invention, FIG. 8 is a perspective view to another embodiment of the reinforcement ring, and FIG. 9 is a sectional view of FIG. 8 when the reinforcement is removing.

DETAILED DESCRIPTION OF THE PREFERRED EMBODIMENT

Figure 1:
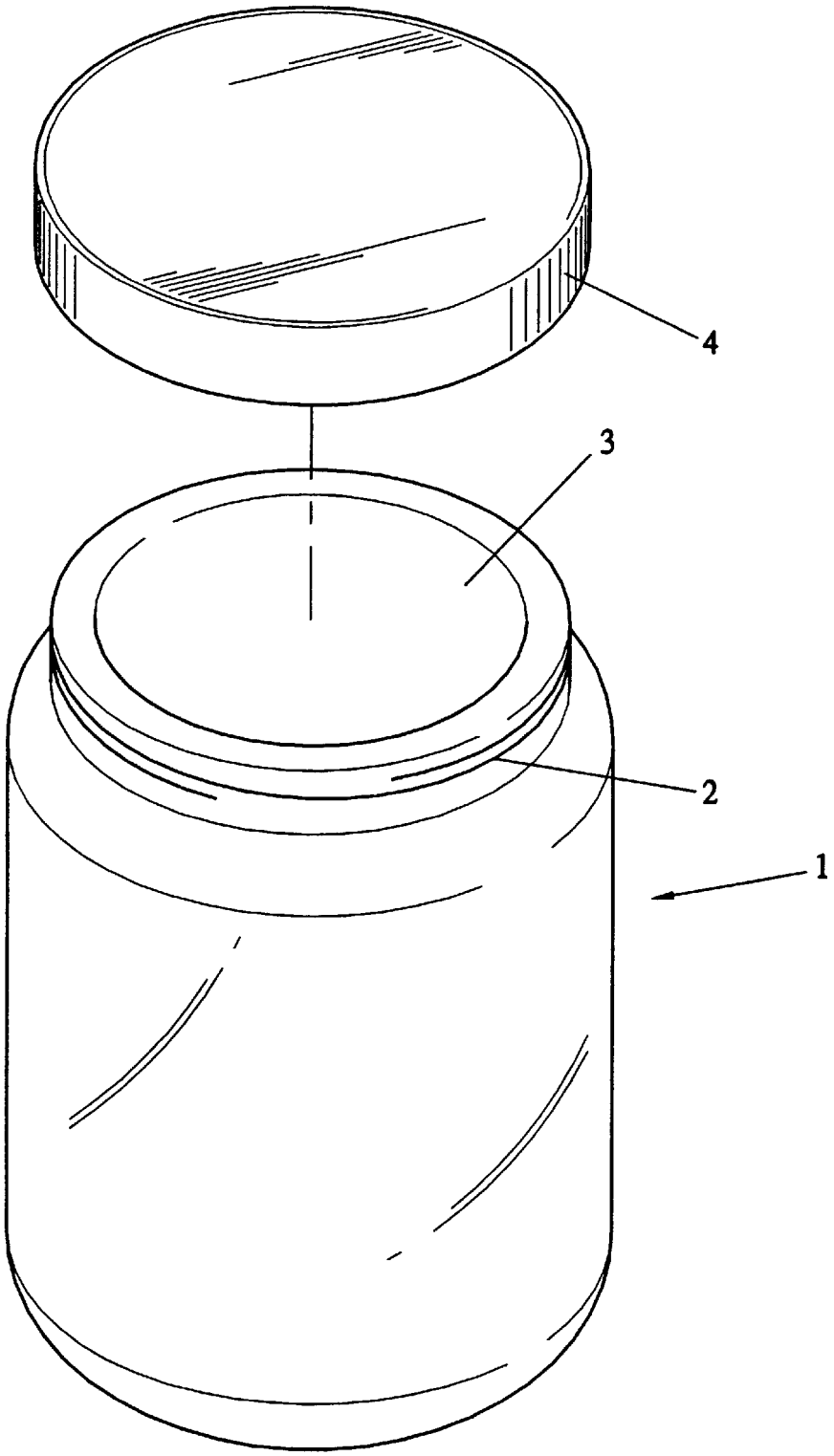
FIG.1 Prior Art
Figure 2:
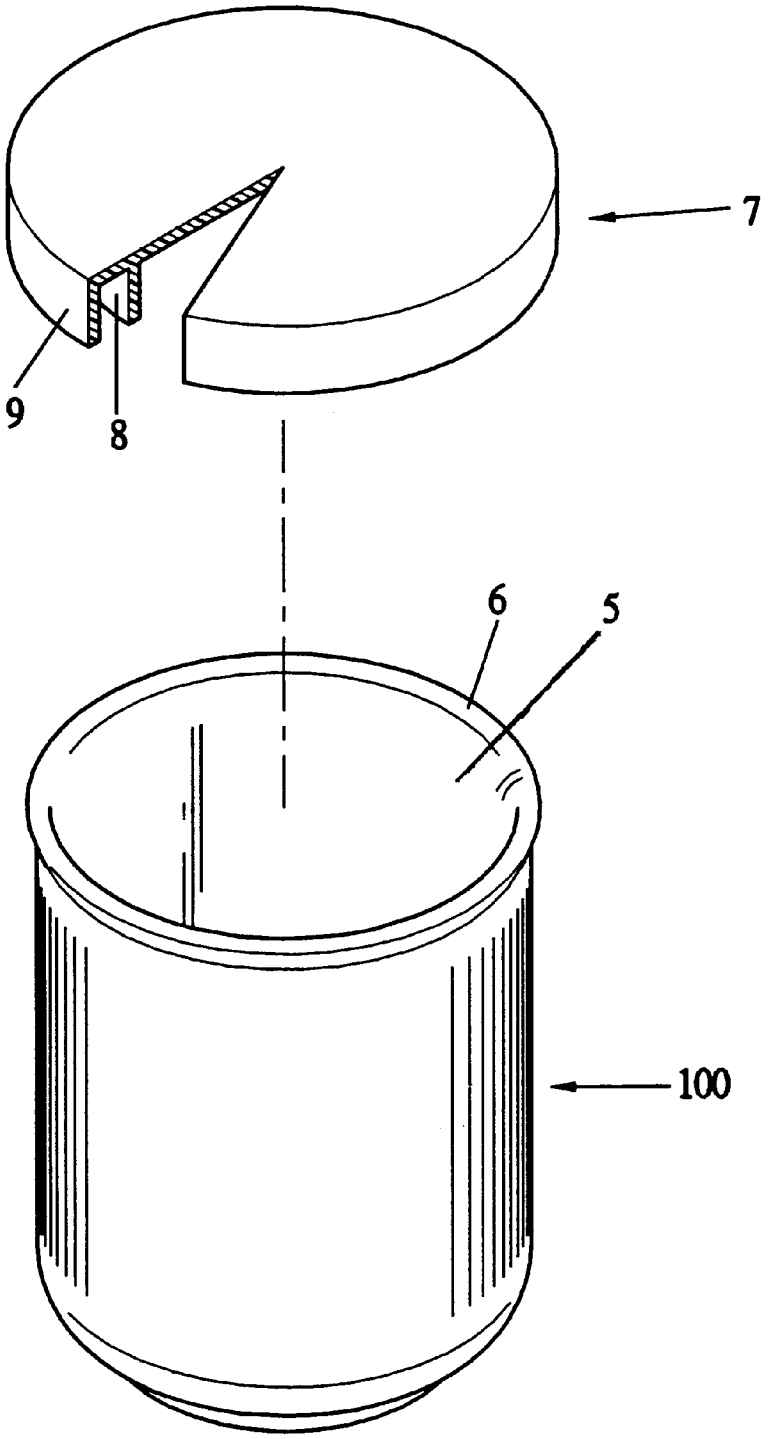
FIG.2 Prior Art
Figure 3:
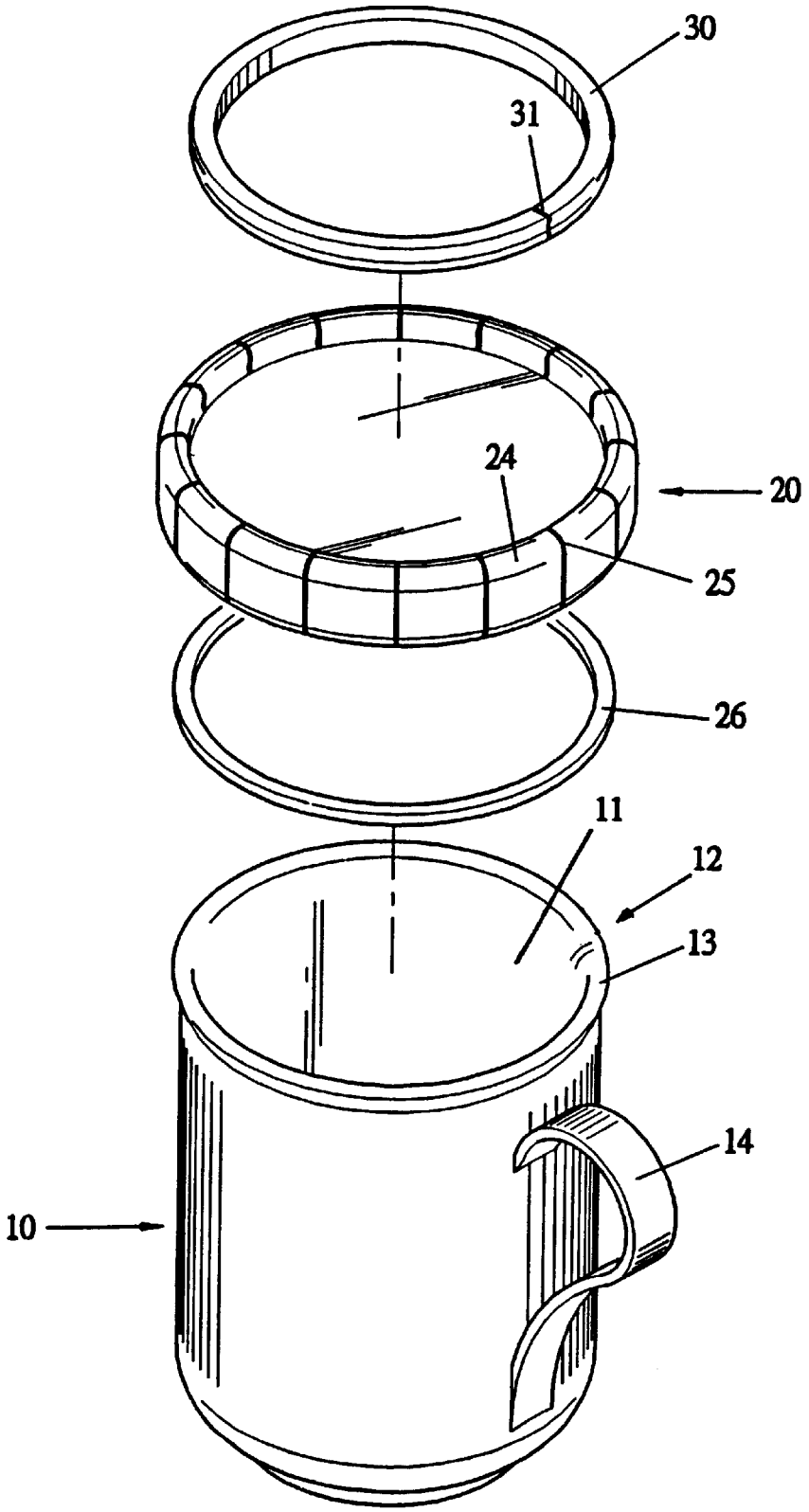
Figure 4:
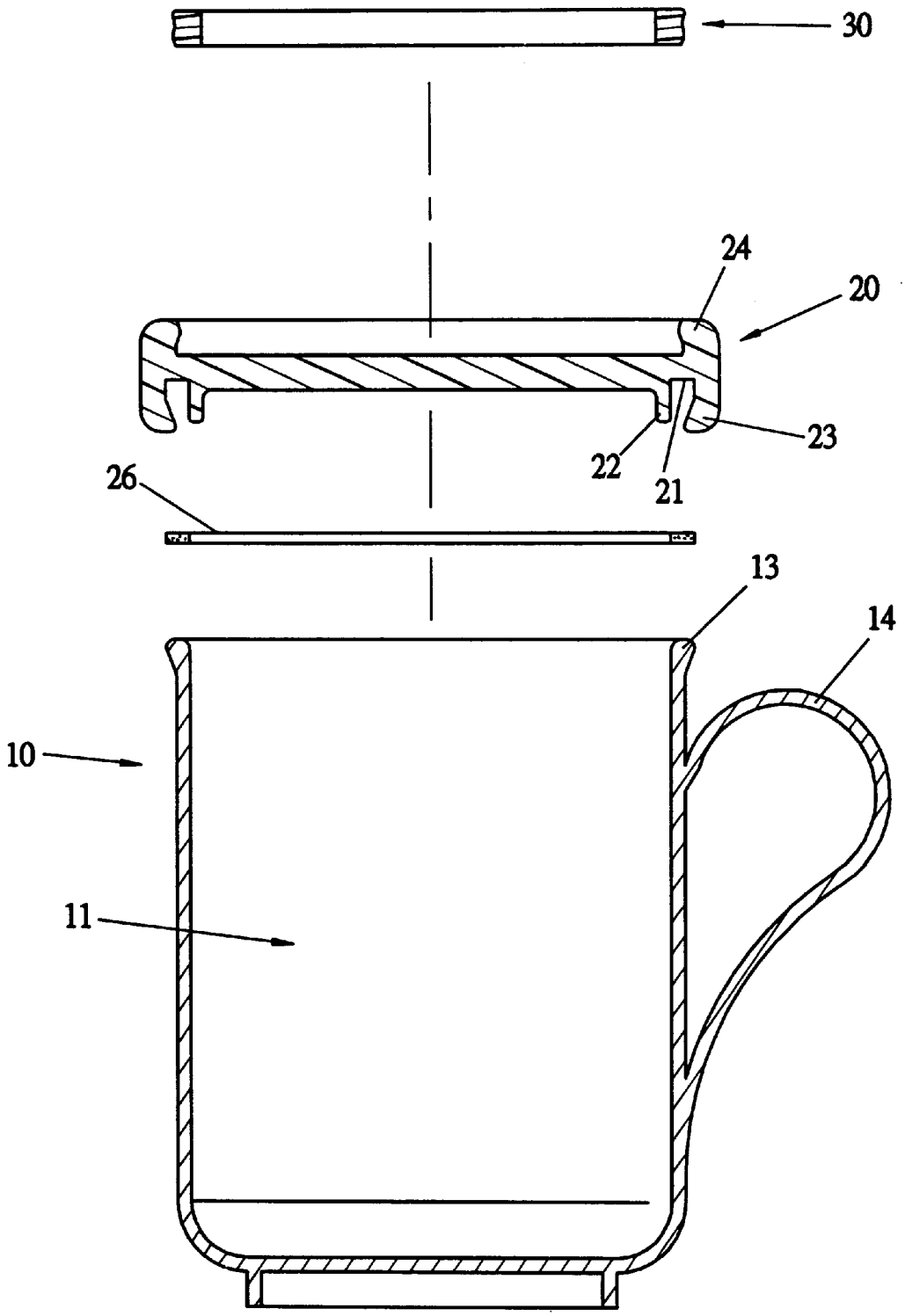

With reference to FIGS. 3 and 4 of the drawings, the structure of the squeeze lid of the present invention comprises a cylinder container 10 made of glass, metal or rigid plastic and including a hollow interior 11, an upper opening or mouth 12, a sloped flange 13 slightly extending outward from the rim of the opening 12 and a handle 14 on an outer periphery, and a squeeze lid 20 made of flexible materal including a circular body, a first and a second lower flange 22 and 23 concentrically formed and downwardly extending from the edge of the body wherein the second lower flange 23 slightly longer the first lower flange 22 and slightly toward inward so as to define an annular gap 21 therebetween engageable with the sloped flange 13 of the container 10, a cushion ring 26 disposed into the annular gap 21, and an upper annular flange 24 extending upward from the edge of the body in which a plurality of first radial slits 25 are spacedly formed. A reinforcement ring 30 engageable the circular space within the upper annular flange 24 and stopped against the inner periphery of the upper annular flange 24. The reinforcement ring has a second radial slit 31 which is provided to give a flexibility to the ring 30 and to facilitate a ready removal of the ring 30. Actually, the surface of the container can decorate with patterns so as to add cosmetic effect.

Figure 5:
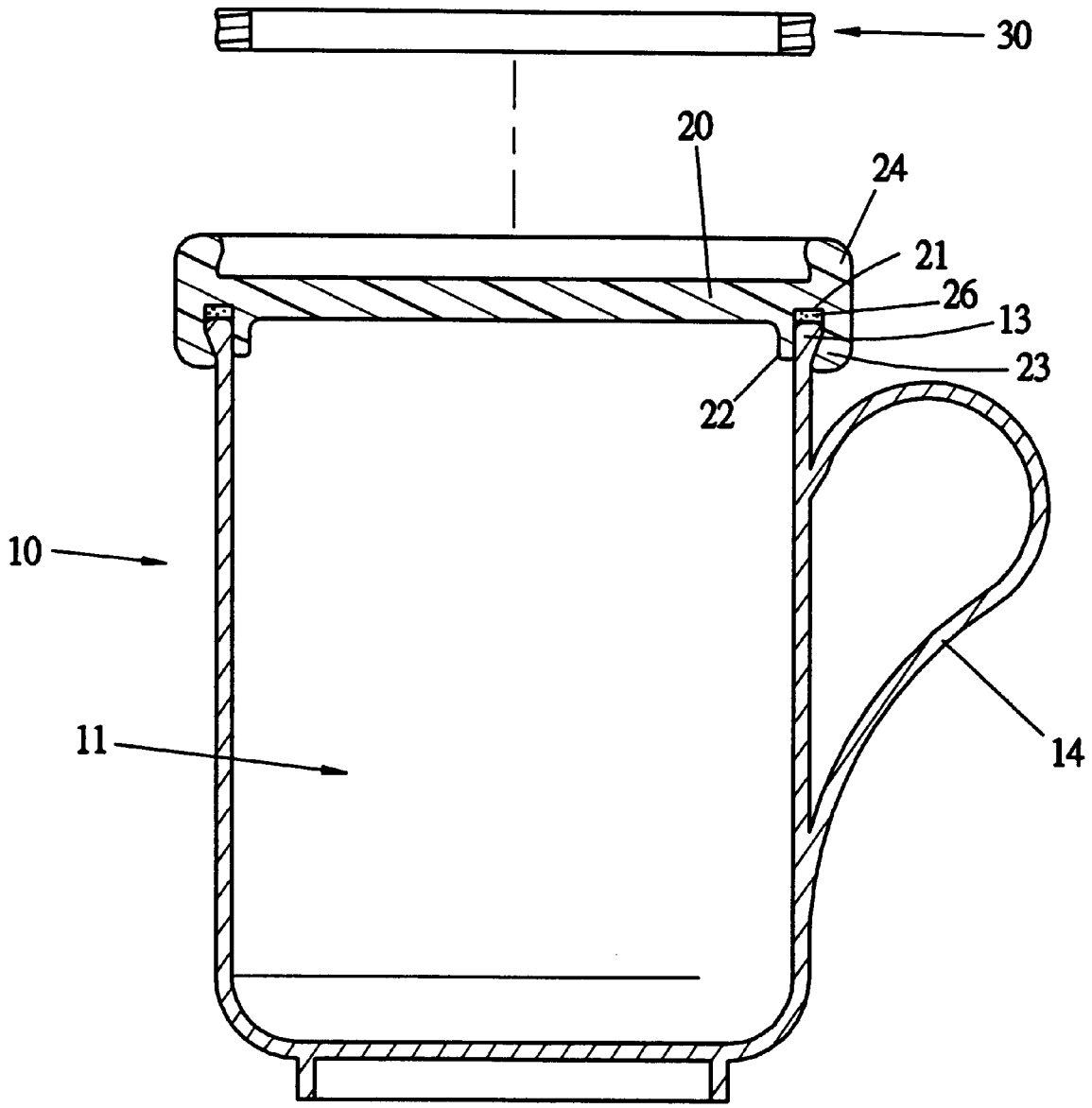
Figure 6:
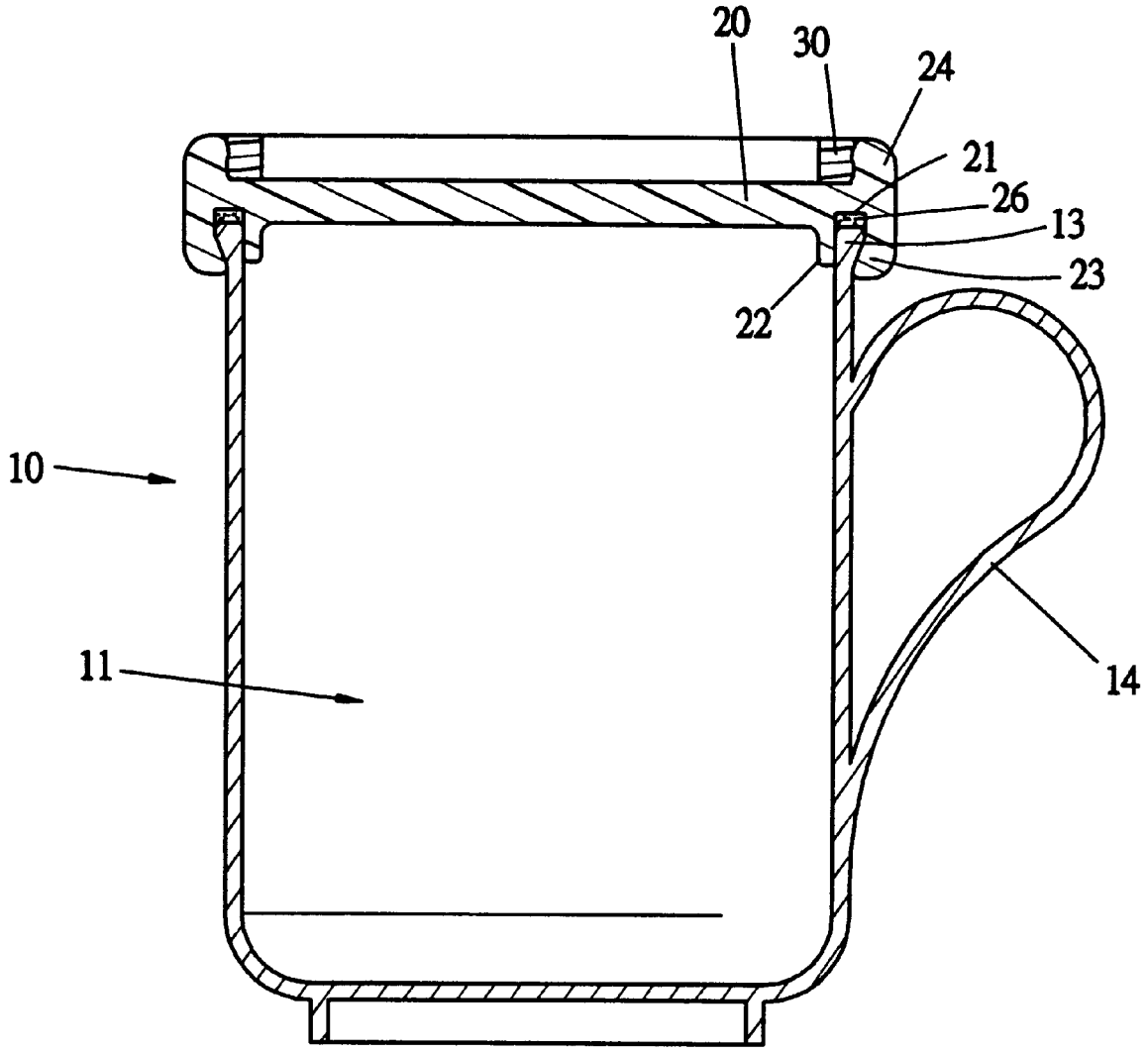
Figure 7:
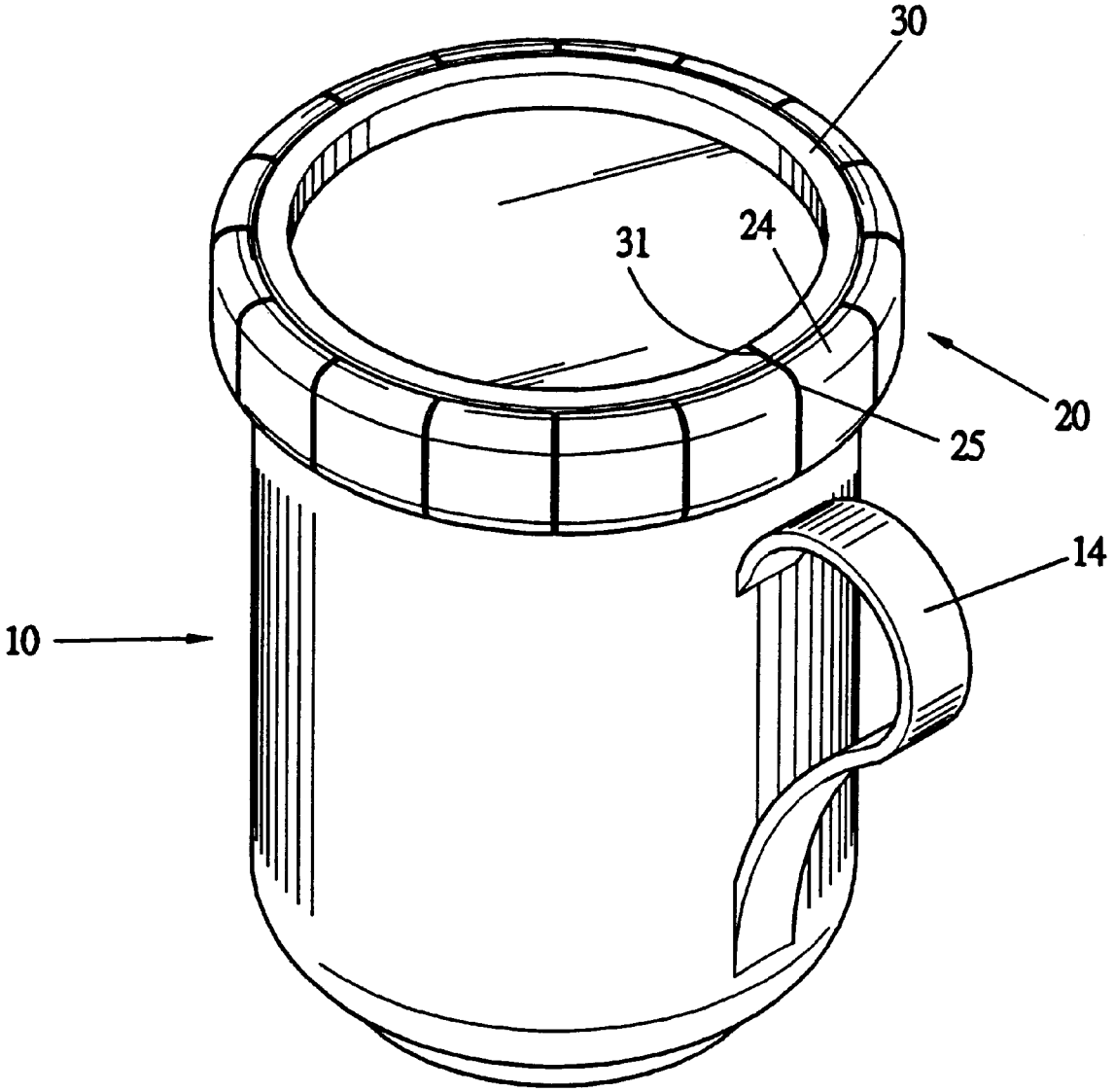

Based on aforediscussed embodiment, which closes the container 10, first engage the sloped flange 13 of the container 10, then press the reinforcement ring 30 into the circular space on the top of the lid 20 so that the reinforcement ring 30 forces the upper annular flange moving outward, the second lower flange 23 effected by the upper annular ring 24 in turn moves inward to closedly abut the outer periphery of the sloped flange 13 in order to tightly cover the container 10. Because of the first and second lower flanges closedly engage the rim of the container 10. The food or beverages inside the container 10 will not leak out (as shown in FIGS. 5, 6 and 7).

Figure 8:
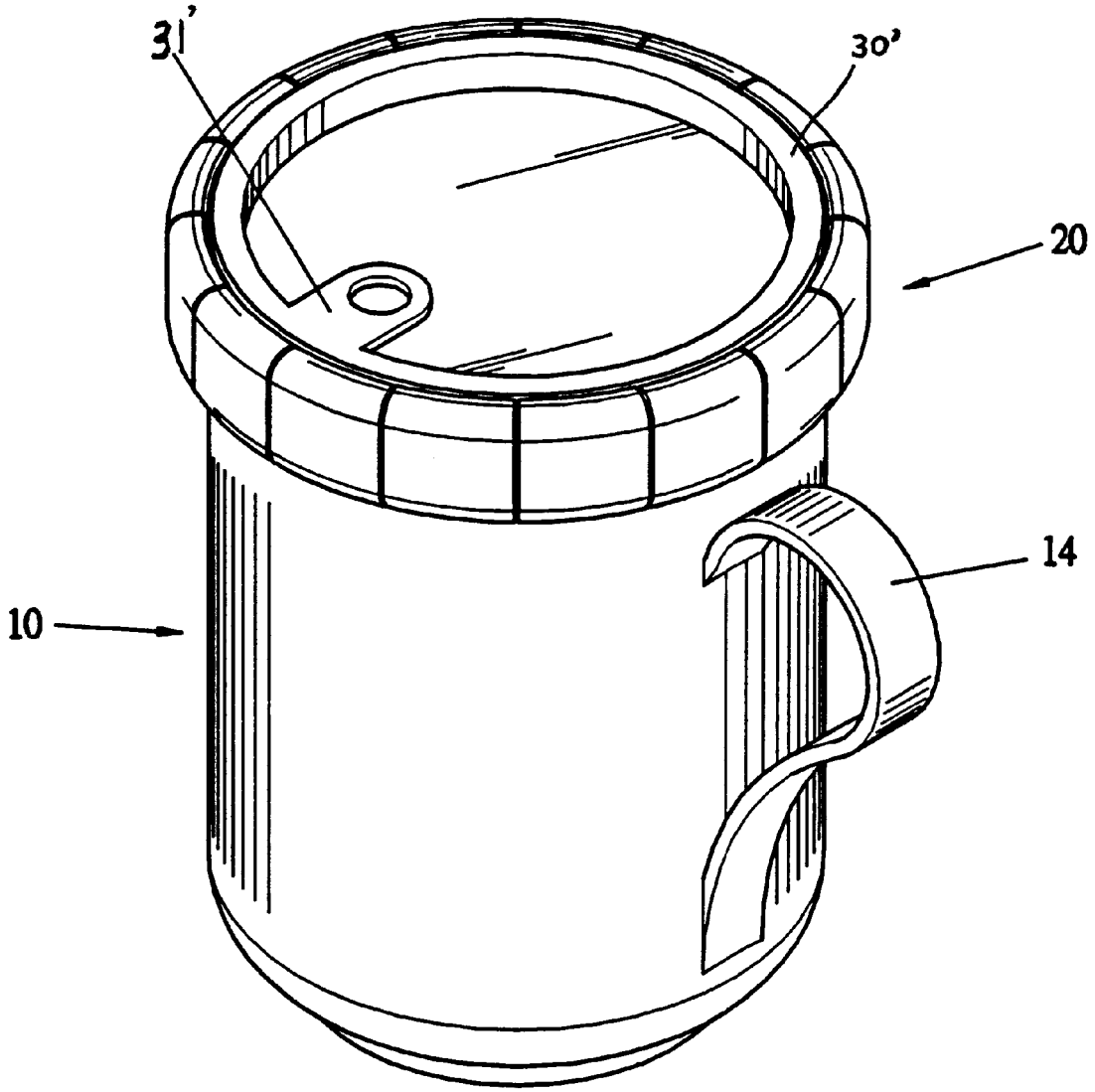

Referring FIG. 8 which shows another embodiment of the reinforcement ring and is designated as 30'. This reinforcement ring 30' includes a finger tab 31' instead of the second radial slit 31 of the above embodiment. The finger tab 31' may more readily remove the reinforcement ring 30' from the lid 20.

Figure 9:
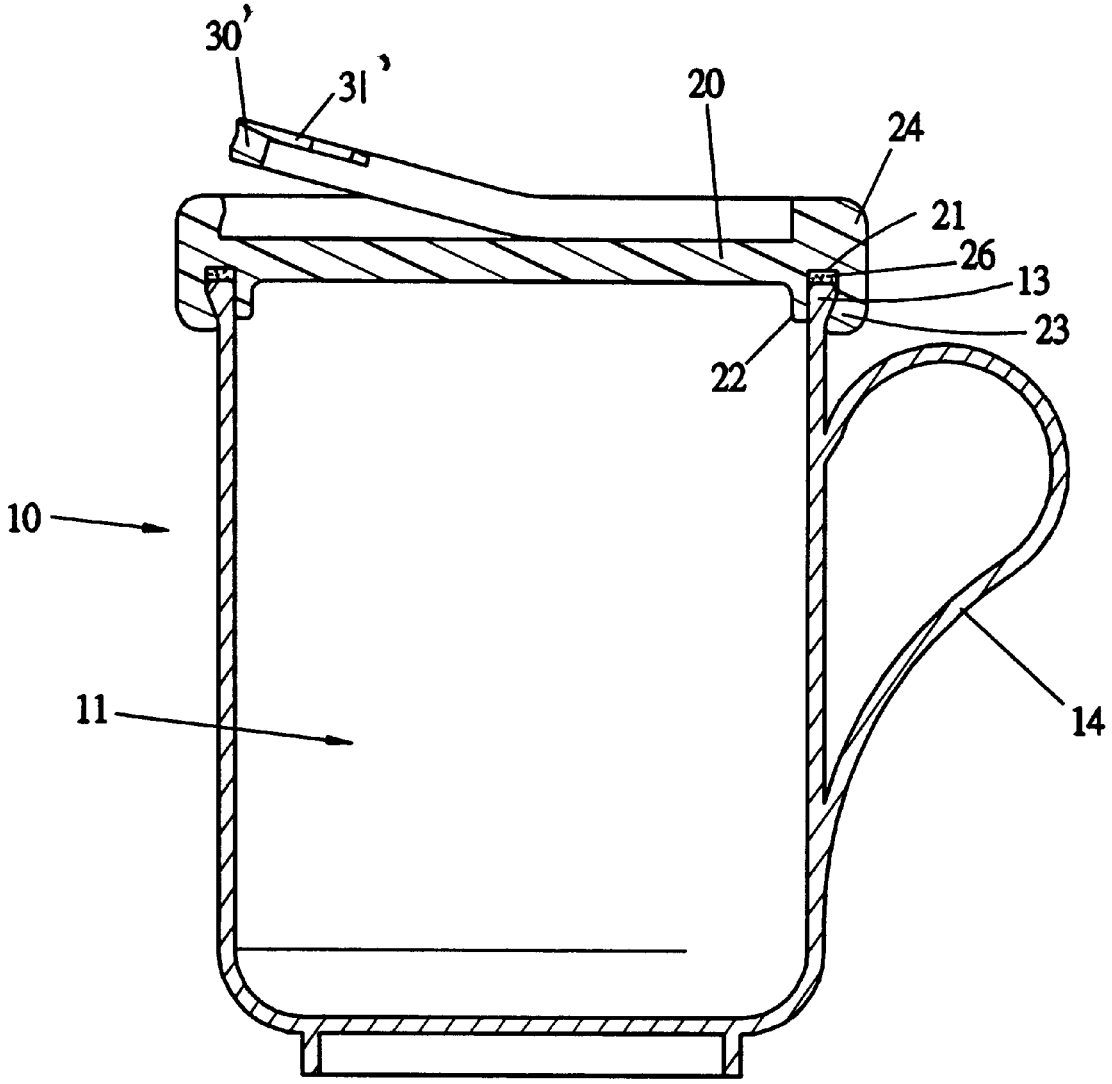

When opens the lid 20, it is simply removing the reinforcement ring 30 or 30', a first the second lower flange 23 will naturely disengage with the sloped flange 13 and lid 20 becomes removable (as shown in FIG. 9).

It is understood that the squeeze lid 20 of the present invention provides a tightly closing of a non-threaded container 10 and the container 10 can be utilized as cup, a vase or the like. So that this novel design is economical and fits to the enviromental requirement.

Note that the specification relating to the above embodiment should be construed as exemplang rather as limitative of the present invention, with many variations and modification being readily attainable by a person of average skill in the art without departing from the spirit or scope thereof as defined by the appended claims and their legal equivalents.

I claim:

1. An apparatus for covering a container comprising:

a container having a cylinder body, an upper opening, a sloped flange slightly extending outward from the opening and a handle on a lateral periphery;

a squeeze lid of a circular body including first and second lower flanges concentrically formed and extending downward from an outer edge of the body wherein the second lower flange is slightly longer than said first lower flange and extends slightly inward so as to define an annular gap therebetween engageable with the sloped flange of said container, an upper flange extending upward from the edge of the circular body to define a circular space in the upper surface of the body and a plurality of first radial slits spacedly formed in said upper flange;

a reinforcement ring including a second radial slit in a circumference thereof, said reinforcement ring being engageable into the circular space of said squeeze lid and stopped against the inner periphery of said upper flange;

whereby said reinforcement ring presses the upper flange of said squeeze lid and forces the second lower flange inward to tightly close the upper opening of said container.

2. The apparatus according to claim 1 wherein said squeeze lid is made of a flexible material.

3. The apparatus according to claim 1 wherein said container is made of glass, metal or rigid plastic.

4. The apparatus according to claim 1 wherein said reinforcement ring further includes a finger tab extending inward from an inner periphery thereof.

5. The apparatus according to claim 1 wherein said container may be decorated with patterns on the outer periphery.

* * * * *